United States Patent [19]

Penland, Sr.

[11] Patent Number: 4,462,712

[45] Date of Patent: Jul. 31, 1984

[54] METHOD AND APPARATUS FOR A CONSTRUCTION SITE FLOORING SYSTEM

[75] Inventor: Joe E. Penland, Sr., Nederland, Tex.

[73] Assignee: Quality Mat Company, Nederland, Tex.

[21] Appl. No.: 283,830

[22] Filed: Jul. 16, 1981

[51] Int. Cl.[3] ..... E01C 5/14

[52] U.S. Cl. ..... 404/36; 52/125.2; 52/581; 52/745; 404/46

[58] Field of Search ..... 52/125, 122.1, 125.2, 52/125.3, 745, 169.1, 392, 581, 593, 590, 177, 665, 741; 404/36, 46

[56] References Cited

U.S. PATENT DOCUMENTS

| | | | |
|---|---|---|---|
| 2,264,377 | 12/1941 | Hoffman | 52/745 |
| 2,306,520 | 12/1942 | Bunker et al. | 52/581 |
| 2,315,448 | 3/1943 | Nagin et al. | 52/581 |
| 2,335,556 | 11/1943 | Wilson | 404/36 |
| 2,652,753 | 9/1953 | Smith | 52/581 |
| 2,886,370 | 5/1959 | Liebert | 52/125.3 |
| 2,912,909 | 11/1959 | Hart | 404/36 |
| 3,990,197 | 11/1976 | Johnston | 52/125.2 |
| 4,001,988 | 1/1977 | Riefler | 52/125.2 |
| 4,289,420 | 9/1981 | Davis et al. | 52/581 |

FOREIGN PATENT DOCUMENTS

| | | | |
|---|---|---|---|
| 414124 | 1/1966 | Switzerland | 52/392 |

*Primary Examiner*—John E. Murtagh

*Attorney, Agent, or Firm*—Arnold, White & Durkee

[57] ABSTRACT

A method and apparatus for the construction of a flooring system for use at a construction site such as an oil well drilling site. The flooring system is formed by interlocking a plurality of flooring units. Each of the flooring units includes a rectangular base section and a surface section attached to and overlaying the base section. One end of the rectangular base section is aligned with one end of the surface section which has at least one open-ended locking slot along its length. Located on the opposing end of the surface section is at least one locking tab formed from the surface section and projecting beyond and above the edge of the base section. The locking tab is aligned with the locking slot of the flooring unit. The method of constructing a flooring system utilizing such units includes positioning one unit, with the use of a lifting device such as a crane, adjacent to a second flooring unit and inserting the locking tab of the first unit into the adjacent second unit. By interlocking a plurality of such units, a flooring system is fabricated at a construction site which is strong enough to support heavy equipment, yet easily installed and removed.

3 Claims, 4 Drawing Figures

METHOD AND APPARATUS FOR A CONSTRUCTION SITE FLOORING SYSTEM

BACKGROUND OF THE INVENTION

A. Field of the Invention

The present invention relates generally to a construction site flooring system, and more particularly to a flooring system formed of a plurality of interlocking flooring units having locking tabs and slots which may be positioned and retained in place without additional fastening means.

B. Description of the Prior Art

In recent years the search for oil has reached enormous portions. This search has extended into many geographic areas which heretofore were inaccessible to heavy equipment without substantial expense, such as swamps, marshlands, riverbeds or snow-covered regions. In order to explore for in such areas, it is necessary to locate heavy drilling rigs, vehicles and other equipment for some period of time on or adjacent to the location where the well is to be drilled. In order to transport this heavy equipment to the site and to support the equipment at the site, the industry has utilized for many years temporary roads leading to and from the site and flooring systems or pads at the particular site.

These prior art systems have typically taken the form of a series of wooden boards laid parallel to one another to form a layer. Multiple layers of such boards are formed by laying the individual boards perpendicular to the boards of the underlying layer. In the past, such board roads and pads have been constructed by hand by placing each individual board in position. Typically, a drilling site pad is constructed by manually laying one board at a time to form a layer of spaced, parallel boards of various lengths along the ground. A second layer of boards is then manually placed on top of the first layer with the boards of the second layer running perpendicular to the boards of the first layer. The boards of the second layer are typically nailed onto the underlying boards and retained in position. Often times it is necessary to overlay a third layer of parallel boards in a direction perpendicular to the boards of the underlying layer. Such a crisscrossing pattern of layered boards is continued until a pad of sufficient size and strength is formed.

After installation of such a flooring system and a road leading thereto constructed in a similar manner, the equipment is placed in position on the pad and drilling operations are begun. Upon completion of the well, the equipment, the pad and the road are typically removed. To remove the pad constructed by the prior art method, it is necessary to again manually remove each individual board since they are typically nailed to one another. Often times the boards are broken or damaged when the nails are removed or the boards are bundled together and transported to a second location. Also, since at least the bottom layer of boards are laid directly on the ground, they often times become embedded in the ground to such an extent that they cannot be removed easily or without being broken or damaged.

As a result of these disadvantages, the prior art method and apparatus of installing such flooring systems and roads requires large amounts of time and manual labor to install and remove. Such systems often sustain large amounts of damage to the individual boards during removal and relocating.

Also existing in the prior art are devices often referred to as crane mats. These units typically consist of a plurality of parallel, wooden timbers which have been secured together to form a rectangular mat. Such mats have been used to build runways or roads upon which a heavy piece of equipment such as a lifting crane or tractor may be driven. These mats, however, have not included any means to interconnect or lock the mats to one another. Also, since large wooden timbers are typically used, multiple layers of such mats are typically not used.

As a result of the shortcomings of the prior art, typified by the methods and apparatus as described above, there has developed and continues to exist a substantial need for a flooring system which can be easily and economically installed at a construction site such as an oil well drilling site. Despite this need, an economical yet efficient flooring system has heretofore been unavailable.

SUMMARY OF THE INVENTION

It is, therefore, a feature of the present invention to provide a flooring system to be installed at a building site which is economical to install and can be easily reused at other locations without substantial damage to the system.

It is another feature of this invention that the system may be installed without the necessity of large amounts of manual labor.

A still further feature of the present system is the use of individual flooring units of substantial size which can be interlocked together to form a flooring system of sufficient strength to support heavy construction equipment.

An additional feature of the present invention is the ability to quickly install and remove a flooring system using a lifting device such as a crane without significant damage to the components of the system.

Finally, a feature of the invention is the installation of a flooring system having interlocking units which can be easily locked and unlocked without large amounts of manual labor or damage to the units of the system.

The present invention is advantageous over the prior art in that the same is economical to construct, easy to install and remove, may be reused many times without substantial damage to the individual components and effectively achieves the combined advantages of providing a flooring system of sufficient strength to withstand heavy equipment while being quickly and economically installed.

The present invention is summarized in that a flooring system for installation at a construction site is formed with a plurality of interlocking floor units. Each of the floor units includes a rectangular base section having a first and a second end and a rectangular surface section having its first and second ends aligned with the corresponding ends of the base section. The surface section is overlaid upon the base section and includes at least one open-ended locking slot along one of its ends. At least one locking tab is formed from the surface section and projects from the first end of the surface section. The locking tab is aligned with the locking slot of the opposed end of the unit whereby the locking tab of a first flooring unit may be inserted into the locking slot of an adjacent flooring unit to form an interlocking pair of units.

So that the manner in which the above-recited advantages and features of the present invention, as well as others which will become apparent, are attained and can be understood in detail, more particular description of the invention, briefly summarized above, may be had by reference to the embodiments there which are illustrated in the appended drawings, which drawings form a part of this specification.

It is to be noted, however, that the appended drawings illustrate only a typical embodiment of the invention and are, therefore, not to be considered limiting of its scope, for the invention may admit of other equally-effective embodiments.

DESCRIPTION OF THE PREFERRED EMBODIMENTS

Figure 1:
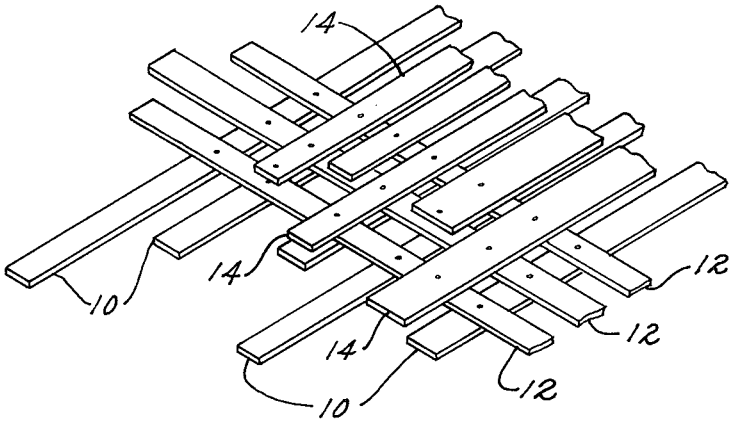
FIG. 1 PRIOR ART
FIG. 1 is a perspective view of a prior art flooring system showing the multiple layers of random length boards.

Referring first to FIG. 1, one embodiment typifying the prior art method and apparatus is shown. Prior to the present invention, a construction site such as a proposed site at which an oil well was to be drilled was often provided with a flooring system or pad upon which the heavy equipment, such as drilling rigs, trucks and other vehicles, was to be stationed. The flooring system typically installed at such drilling sites consists of multiple layers of wooden boards arranged to provide sufficient strength to support the vehicles and equipment necessary for the job to be done at the construction site.

Since many drilling sites are often located in low lying areas such as swamps or riverbeds, it is often necessary to provide a relatively firm, stable surface to support the heavy machinery to be used. Also, due to the great weight of the machinery, roads leading to and from the proposed drilling site are often equipped with an artificial surface. This surface must provide sufficient support for vehicles travelling along the road even during periods of prolonged rain or snow and yet be easily removed and reused at other locations.

Referring back to FIG. 1, there is shown a series of wooden boards typically used in the industry to provide such a road and flooring system for a construction site. Typically, this construction site flooring system consists of a series of wooden boards placed directly on the ground parallel to one another and spaced apart from one another as shown in FIG. 1. These first layer boards 10 are typically of random length and placed end-to-end to form a parallel network of foundation boards. After the first tier or layer of foundation boards 10 is in place, a second tier or layer of boards 12 is then laid perpendicular to the foundation boards 10 as shown in FIG. 1. The second layer of boards 12 is again positioned substantially parallel to one another but spaced closer together than the foundation boards 10. As can be appreciated from an examination of FIG. 1, foundation boards 10 and second layer boards 12 form a grid system of boards of random length. To ensure that the flooring system is stable, often times second layer boards 12 are nailed to foundation boards 10 in place.

Often the soil at the drilling site location is so soft that it is necessary that additional tiers or layers of boards be overlayed upon the second layer of boards 12. In FIG. 1, a third or surface layer is overlaid upon boards 12. This surface layer is again formed of random length wooden boards 14 placed substantially perpendicular to the underlying boards 12 and parallel to the adjacent boards in the surface layer. Boards 14 are spaced parallel to one another an amount sufficient to provide adequate support for the vehicles and other equipment which will be travelling along or positioned upon the supports.

As can be appreciated by one skilled in art, the construction of a road or flooring pad using individual boards 10, 12 and 14 layered upon one another as shown in FIG. 1 requires substantial labor which typically cannot be performed by machines. Rather than equipment, manual labor is typically used to position and nail each individual board in its proper position.

Figure 2:
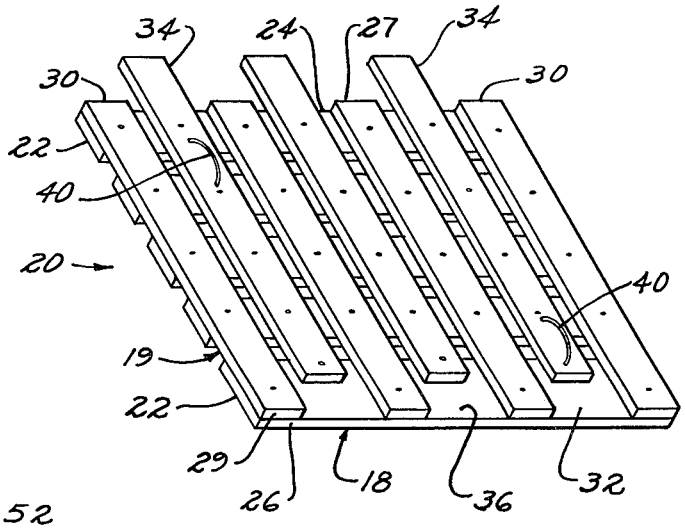
FIG. 2 is a perspective view of a flooring unit built according to the present invention.
Figure 3:
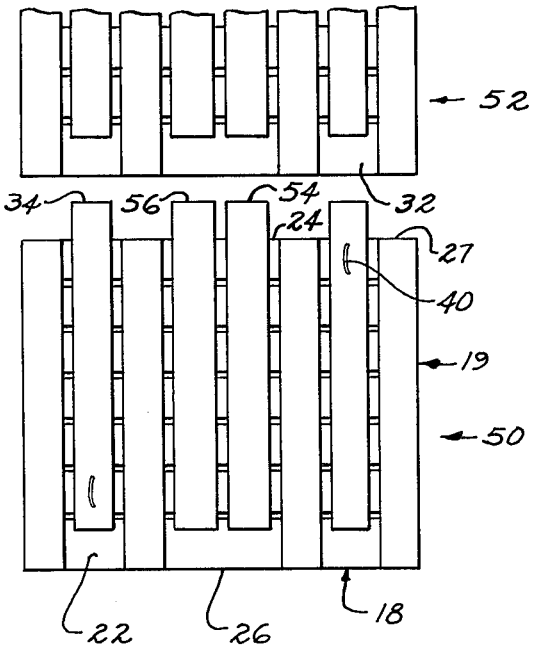
FIG. 3 is a plan view of two flooring units built according to a second embodiment of the present invention.
Figure 4:
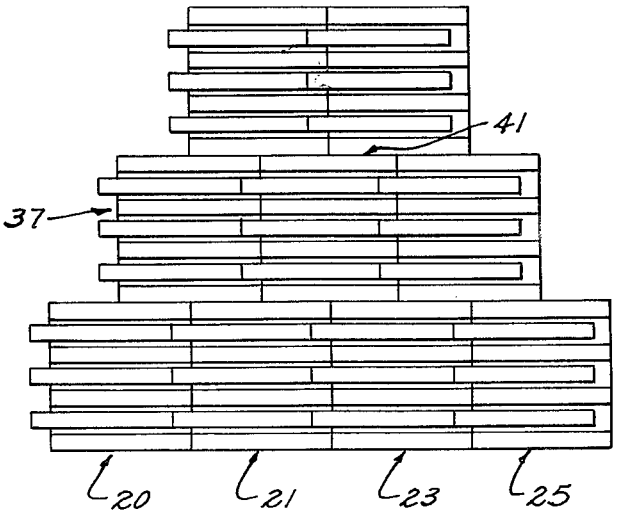
FIG. 4 is a perspective view of the flooring system of the present invention as installed using a series of the flooring units shown in FIG. 2.

Referring now to FIGS. 2 through 4, a preferred embodiment of a flooring system for use at a construction site such as an oil well drilling site includes a plurality of interlocking flooring units 20. Hereinafter, the present invention will be referred to as a flooring system, however, it is contemplated that the system may also be employed to construct a road leading to the construction site. The system may be employed in any desired shape by the user to construct a hard surface upon which heavy equipment may be transported or stationed.

Referring first to FIG. 2, an individual flooring unit of the present invention is shown and described. The flooring unit 20 includes a rectangular base section 18 with a rectangular surface section 19 attached to and overlaying the base section as shown in FIG. 2.

The base section 18 of the embodiment shown in FIG. 2 is formed of a plurality of parallel boards 22 of substantially equal length. Each board 22 is positioned parallel to an adjacent board to form a flat, base section.

Overlaying the base section 18 is surface section 19 which may also be formed of a plurality of parallel boards 30 of uniform length. Each surface section board 30 is attached to the underlying base section boards 22 by means of any conventional connection means such as nails, or a nut and bolt assembly. Each of the surface section boards 30 is aligned with one another to form a series of parallel boards connected substantially perpendicular to the boards 22 of the base section 18.

Referring again to FIG. 2, rectangular base section 18 includes a first end 24 and second end 26. Aligned with the first end 24 of base section 18 is the first end of the surface section 27. Also, a second end 29 of the surface section is aligned with and overlaying the second end 26 of the base section 18 as shown in FIG. 2.

The flooring units 20 shown in FIG. 2 includes at least one open-ended locking slot 32. The embodiment of FIG. 2 discloses three such locking slots formed by the upper surface 36 of base section 18 and two side surfaces of section boards 30.

The flooring unit 20 of FIG. 2 further includes a plurality of locking tabs 34 attached to the surface section and projecting from the first end 24 of the surface section 19. Each of the locking tabs 34 is aligned with a corresponding open-ended locking slot 32. The embodiment shown in FIG. 2 provides that the locking tabs 34 are integrally formed from the surface section boards 30. By selectively positioning alternative surface section boards 30, locking tabs 34 and locking slots 32 are formed. It has been determined that the amount that locking tab 34 extends beyond the first end 24 of the flooring unit 20 should be an amount less than the width of the base section board 22 which forms the bottom surface or lower portion of locking slot 32. By such a relationship, it is possible then to securely fasten the end of each of the surface section boards 30 which have been "shifted" to form the locking slot 32 to the base section 18 as can be seen in FIG. 2.

Referring again to FIG. 2, each of the flooring units 20 is provided with at least one means for attaching a lifting line or other device used to lift and position the flooring units. In the embodiment of FIG. 2, this attachment means takes the form of flexible attachment loops 40 which are connected to the upper surface section 19. Although it can be appreciated that such attachment means may take any of several forms, the embodiment shown in FIG. 2 consists of a flexible wire cable which has both of its ends connected to surface section 19. These flexible attachment loops 40 do not provide any substantial obstacle to the use of the flooring system after installation since they are easily flattened by any vehicle which happens to pass over them.

Referring now to FIG. 3, an alternative embodiment of the flooring unit is shown. In this embodiment, the locking tabs 34 are again formed from the surface section boards 30 by "shifting" each board a predetermined amount. But, in this embodiment, alternative surface section boards 30 are not shifted but rather the two adjacent center surface section boards designated 54, 56 in FIG. 3 are shifted to form locking tabs even though they are adjacent to one another. As can be seen from FIG. 3, the double locking tab arrangement disclosed in FIG. 3, provides additional support for the central portion of each flooring unit.

As can be appreciated by one skilled in the art, in addition to the base section 18 and surface section 19 shown in FIG. 3, additional layers of boards may be provided if additional strength or depth is needed. Such additional layers or tiers of boards may be added to the underside of base section 18 as shown in FIG. 2. This would allow the utilization of locking tabs 34 and locking slots 32 without interference and without regard to the additional layers of boards added to base section 18 as needed for strength or thickness. Of course, additional layers of board may be added to the top of surface section 19 to obtain the desired strength. Also, a surface layer consisting of sheet material such as plywood may be overlaid upon section 19 if needed or desired by the user.

METHOD OF INSTALLATION

Referring in particular to FIGS. 3 and 4, a method for constructing a flooring system to be used at a construction site is disclosed. It is contemplated that during the installation of such a flooring system a crane or other lifting equipment is available at the site which includes a lifting line which may be attached to the individual flooring units for unloading such units from the vehicle which transported the units to the construction site.

The method contemplated for installing such a system includes providing a plurality of the flooring unit 20 as previously described. Each of these flooring units 20, of course, would have at least one locking tab 34 on one end and an open-ended locking slot 32 aligned with the locking tab 34 on the opposed end. Referring to FIG. 3, two such units 50, 52 are shown. First unit 50 is shown with its locking tabs 34 aligned and adjacent to the locking slots 32. Once the second unit 52 is properly positioned on the drilling site, the lifting line of the crane is connected to the attachment loops 40 and the first unit 50 is lifted sufficiently to align the first flooring unit 50 with the second flooring unit 52 as shown in FIG. 3. Once the units 50, 52 are aligned, the locking tabs 34 of unit 50 are positioned in the locking slots 32 of unit 52 thereby interlocking first unit 50 with second unit 52. The first unit 50 is then lowered into position by the lifting crane and the lifting line is disengaged from the first unit. As can be appreciated, as a result of the foregoing, the units 50, 52 are positioned and fitted together to form a portion of the flooring system.

The operation previously described is then repeated with respect to a third flooring unit (not shown) which is aligned and attached to the end of the first unit 50 having locking slots 32 at its end portion.

By repeating the above-described method, a series of flooring units are interfitted together to form an elongated strip of flooring support. Referring to FIG. 4, the preferred staggering or checkerboard pattern is disclosed. As seen, flooring unit 20 is aligned with and interlocked to an adjacent flooring unit 21. Additional units 23 and 25 are also added to form a long, continuous strip of flooring support which extends across the length or width of the drilling site. Adjacent to this flooring strip a second strip is installed by interlocking similar flooring unit. However, the interlocking seam created by locking slots 32 and tabs 34 is offset or staggered with respect to the adjacent flooring strip as shown in FIG. 4. For example, flooring unit 37 is positioned parallel and adjacent to unit 20 yet its interlocking end is positioned adjacent the central portion of unit 20 and offset from the interlocking ends of unit 20. Flooring unit 37 is interlocked to unit 41 at a seam offset from the connecting seams of unit 20. As can be understood, such a staggering pattern is considered beneficial such that lines of continuous weakness caused by the interlocking seam are not formed in the flooring system.

It should be noted that the above description does not call for the use of nails or other fastening means to connect the individual flooring units to one another such as units 20 and 21 of FIG. 4. Also, parallel units such as unit 37 and unit 20 are also not connected by attachment means such as nails. Applicant has discovered that the use of the interlocking slots and tabs provides a sufficient connection and support as to withstand normal construction site usage. In the past, prior art devices have utilized nails or other connection means to nail the individual boards to adjacent boards. The system of the present invention does not utilize such fastening means but rather utilizes individual flooring units 20, 21 which are interlocked by tabs and slots. Since no fastening means other than the tabs and slots, such as nails, is utilized, it is not necessary then to remove such nails when the operator desires to remove the flooring system.

As previously discussed, if the particular construction site provides insufficient support due to excessive water, or other problems, additional layers of flooring may be installed through the use of additional layers of boards overlaying the flooring unit described herein or individual flooring units may be laid upon one another to form a flooring system consisting of two or more layers of flooring units as described herein.

In additional to the building units such as shown in FIGS. 2 and 3, it may also be necessary to construct flooring units which do not include both locking tabs and locking slots. For example, flooring units to be used along the periphery of the construction site may not need locking tabs 34 extending outwardly since no mating unit is attached thereto. Also, it is often found in the drilling of oil wells that a pit or other opening is needed in the flooring pad. To form such an opening, it may be necessary to use building units which do not have the locking tabs extending along one edge about the periphery of the pit. In such instances, it is contemplated that building units may be constructed which do not have locking tabs 34 but rather only locking slots 32 along a single edge. It can also equally be appreciated that building units which do not have locking slot 32 but only locking tabs 34 may also be useful in specific situations.

Referring back to FIG. 3, the particular building unit shown therein has been fabricated by Applicant and found to be sufficient for oil well drilling site in a size approximately equal to 16 feet long and 8 feet wide. The boards utilized for such a unit typically may be 16 feet long by 8 inches wide by 2 inches thick. Although Applicant has referred to the parallel members of the flooring units as boards, this term should be considered in its broad sense and include any elongated member made of wood or other material.

It can, therefore, be appreciated that the method and apparatus for constructing a flooring system at a construction site according to the present invention exhibits numerous advantages in construction, operation and installation while providing a flooring system with sufficient strength to meet the needs of industry. The various embodiments and modifications according to this invention, facilitate the low cost transportation, construction, use and removal of a flooring system for use at such construction sites.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size and arrangement of parts. For example, equivalent elements or materials may be substituted for those illustrated and described herein, parts may be reversed, and certain features of the invention may be utilized independently of use of other features, all as would be apparent to one skilled in the art after having the benefit of this description of the invention.

What is claimed is:

1. A flooring system for use as the temporary surface of a construction site and roadway leading thereto and adapted for supporting heavy equipment such as oil well drilling equipment, the flooring system comprising:

a plurality of adjacent rows of interlocking flooring units, each unit including a rectangular base section having a first end and an opposed second end, said base formed of a plurality of parallel boards of substantially equal length;

a rectangular surface section having a first end and an opposed second end, said surface section attached to and overlaying the base section with the side edges and ends of the surface section aligned with the corresponding side edges and ends of the base section, the surface section formed of a plurality of parallel boards of uniform length interconnected substantially perpendicular to the boards of the base section, the second end of the surface section having at least one open locking slot formed by a pair of upper surface boards and the base section;

a locking tab projecting only from the first end of the surface section, the locking tab being aligned with the locking slot of the second end whereby the locking tab of a first flooring unit may be vertically lowered into the locking slot of an adjacent flooring unit to form a portion of the adjacent rows of flooring units; and a top layer overlaying the surface sections of the flooring units, the top layer formed of a plurality of boards.

2. The flooring system as recited in claim 1 wherein each flooring unit includes a means for attaching a lifting line to each unit such that each unit may be vertically lowered into position in the system with the use of a lifting device such as a crane.

3. A method for constructing a reusable flooring system to be used at a construction site and roadway such as an oil well drilling location with a lifting device such as a crane at the site, the method comprising the steps of:

(a) providing a plurality of adjacent rows of interlocking flooring units, a single end of each of said flooring units having a locking tab extending from said single end and an open locking slot aligned with the locking tab on the opposed end of each of said units, providing said rows of interlocking flooring units including the steps of engaging the lifting device to a first flooring unit;

vertically positioning the first flooring unit with respect to a second flooring unit with the use of the lifting device;

vertically lowering the first unit with respect to the second unit and vertically lowering the locking tab of the first unit into the locking slot of the second unit;

disengaging the lifting device from the first unit whereby the first flooring unit is interlocked to the second flooring unit;

repeating the steps of engaging, vertically positioning, vertically lowering and disengaging while using additional flooring units whereby said rows of interlocking flooring units are formed; and (b) overlaying a top layer to the surface sections of the flooring units, said top layer formed of a plurality of boards.

* * * * *